US006928976B2

(12) United States Patent
Håkansson

(10) Patent No.: US 6,928,976 B2
(45) Date of Patent: Aug. 16, 2005

(54) APPARATUS FOR CONTROLLING A LUBRICATION FLUID LEVEL

(75) Inventor: Nils-Olof Håkansson, Stenkullen (SE)

(73) Assignee: Volvo Lastvagnar AB, Göteborg (SE)

( * ) Notice: Subject to any disclaimer, the term of this patent is extended or adjusted under 35 U.S.C. 154(b) by 0 days.

(21) Appl. No.: 10/604,420

(22) Filed: Jul. 18, 2003

(65) Prior Publication Data

US 2004/0107939 A1 Jun. 10, 2004

Related U.S. Application Data

(63) Continuation of application No. PCT/SE02/00057, filed on Jan. 14, 2002.

(30) Foreign Application Priority Data

Jan. 19, 2001 (SE) ..... 0100151

(51) Int. Cl.[7] ..... F01M 1/00
(52) U.S. Cl. ..... 123/196 R; 184/103.1
(58) Field of Search ..... 123/196 R; 184/6.4, 184/103.1, 105.1

(56) References Cited

FOREIGN PATENT DOCUMENTS

| | | | | |
|---|---|---|---|---|
| DE | 26 01 133 A1 | | 7/1977 | |
| DE | 3532482 A1 | * | 3/1987 | ..... F01M/11/06 |
| DE | 42 14835 A1 | | 11/1993 | |
| JP | 63297720 A | | 12/1988 | |

* cited by examiner

*Primary Examiner*—Noah Kamen
(74) *Attorney, Agent, or Firm*—Novak Druce & Quigg, LLP

(57) ABSTRACT

System and a method for automatically topping up an internal combustion engine (4) with lubricant. A lubricant container that includes a (1), a pipe (2) which connects the container to the internal combustion engine (4), a level pipe (5) which defines the oil level in a sump (6) and an apparatus (3) for transferring lubricant. The apparatus (3) for transferring lubricant makes it possible to transfer lubricant both from the container (1) to the internal combustion engine (4) and from the internal combustion engine (4) to the container (1).

15 Claims, 2 Drawing Sheets

APPARATUS FOR CONTROLLING A LUBRICATION FLUID LEVEL

CROSS REFERENCE TO RELATED APPLICATIONS

This application is a continuation patent application of International Application No. PCT/SE02/00057 filed 14 Jan. 2002 which was published in English pursuant to Article 21(2) of the Patent Cooperation Treaty, and which claims priority to Swedish Application No. 0100151-0 filed 19 Jan. 2001. Both applications are expressly incorporated herein by reference in their entireties.

BACKGROUND OF INVENTION

1. Technical Field

The present invention relates to a system and method for automatically topping up an internal combustion engine with lubricant.

2. Background Art

Various systems for automatically topping up the sump of an internal combustion engine with oil are well known.

Such a system is described in EP 0638708 B1. When the engine is started, in the system described, oil is drawn into the sump from an external oil container by means of negative pressure. When a maximum permitted oil level is reached, an oil level sensor sends a signal to an electrically controlled valve, and topping up with oil is thus stopped. The oil then circulates for a certain time through the external oil container back to the sump. In this way, the oil in the external container is mixed with oil from the sump. Although it is relatively simple, this system has several disadvantages. One disadvantage is that oil is topped up only when the engine starts. When it is cold and the oil is of high viscosity, the oil will flow out slowly, which results in the oil level in the sump not being the same everywhere during topping up. This in turn leads to the quantity of oil in the sump being too great when the level sensor reacts. Another disadvantage of this system is that it utilizes a sensor that stops the topping-up process. In the event of functional problems in the sensor circuit, the entire external oil quantity can end up in the sump. A third disadvantage is that the system requires an oil level sensor mounted in the sump, where it is exposed to vibrations, temperature cycles, old oil, and other detrimental conditions. A further disadvantage is that the oil in the external container is mixed with oil from the sump. When the oil is changed, the oil in both the sump and the external container must be changed and the external container also has to be cleaned.

Another such system is described in EP 0416688 A1. The system described in that specification consists of an external oil container, an electrically controllable valve, a measuring container, a level sensor, an internal combustion engine with an oil sump and a programmable control unit. The oil container is connected to the electrically controllable valve which is in turn connected to the measuring container. The measuring container is connected to the sump according to the principle of communicating vessels so that the oil level of the sump can be measured in the measuring container by means of the level sensor.

The control unit measures the oil level in the measuring container by means of the level sensor before the engine is started; that is to say, in the first position of the ignition switch. If the level sensor provides a signal that the oil level is correct, the engine can be started. If the oil level is too low, a topping-up operation is initiated in which a predetermined quantity of oil is filled into the measuring container and thus into the sump via the electrically controllable valve. The oil level is then measured again. If the oil level is correct, the engine can be started; otherwise another topping-up operation is carried out. If the oil level is still too low, an error signal is generated and the ignition switch is locked. The oil level then has to be inspected manually. The engine can be started using an emergency unit.

This system also has several disadvantages. Above all, it is complicated and contains many components; for example, electrical components, that can give rise to reliability problems, which can lead to operation being disrupted. As the oil level is measured in the measuring container, which is located outside the sump, even a slight inclination of the vehicle can result in the sump containing more oil than necessary, which can lead to increased friction losses (splash losses), more oil mist in the blow-by gases and thus higher oil consumption. The measuring container is connected to the sump via a pipe which is located in a highly exposed position at the bottom of the engine. If this pipe is damaged, the engine is emptied of oil. Moreover, this solution is costly.

SUMMARY OF INVENTION

An objective of the invention is therefore to produce a system for automatically topping up an internal combustion engine with lubricant which is as simple, inexpensive and reliable, and that also contains as few parts as possible. As a method, the invention provides a simple and automatic process for topping up an internal combustion engine with lubricant.

With a system for automatically topping up an internal combustion engine with lubricant as the starting point, the sump of which has a predefined lubricant level and which comprises (includes, but is not limited to) a lubricant container which is connected to the internal combustion engine and an apparatus for transferring lubricant between the container and the sump. An object of the invention is achieved by virtue of the fact that the system comprises a level pipe connected to the container and that is positioned in the internal combustion engine. A mouth of the level pipe is positioned at the level of the predefined lubricant level in the sump. The apparatus for transferring lubricant is adapted in order to transfer lubricant both from the container to the internal combustion engine and from the internal combustion engine to the container. The method according to the invention achieves the object by topping up with more lubricant than necessary and subsequently drawing off surplus lubricant via a level pipe.

By means of this first design of the system according to the invention, the system, in its simplest form, will transfer lubricant to the sump and transfer surplus lubricant from the sump back to the container so that a predefined lubricant level is achieved. The advantage of this is that lubricant is topped up to a predefined level automatically without a special level detector being required.

In an advantageous fifth development of the system according to the invention, this takes place every time the engine is stopped. The advantage of this is that the vehicle is ready for driving next time it is started. If there should be a lack of lubricant or some other fault, the driver is informed of this when the engine is turned off and thus has more time to deal with the problem. Another advantage is that the lubricant is hot and thus of low viscosity, which ensures repeatable and rapid lubricant level adjustment.

In an advantageous second development of the system according to the invention, the transfer of lubrication is carried out by a pump which can be reversed and is operated electrically. The advantage of this is that the control of the pump can easily be integrated into the electronic control system of the vehicle.

In an advantageous third development of the system according to the invention, the pump is controlled by a control unit, the control signal of which can be a function of one or more of the following parameters: fuel consumption, driving distance, total number of engine revolutions during the driving session, the number of starts, accumulated calculated lubricant consumption and external temperature. The advantage of this is that the quantity of lubricant which is pumped back to the container can be minimized.

In an advantageous fourth development of the system according to the invention, the lubricant is transferred in a number of cycles. This is also effected in order to minimize the quantity of lubricant which is pumped back to the container.

In an advantageous sixth development of the system according to the invention, an apparatus can detect whether lubricant is being transferred back to the container and/or detect transfer of lubricant to the sump. The detection signal can be used to turn off the pump which transfers lubricant. The advantage of this is that the quantity of lubricant which is pumped back to the container can be minimized.

According to a second advantageous illustrative embodiment of the system according to the invention, the transfer of lubricant is carried out by a hydraulic cylinder system. In this case, the transfer of lubricant to and from the sump takes place at the same time and in one cycle. The advantage of this is that it is an entirely mechanical solution without any electric components involved.

In an advantageous development of this system according to the invention, the cylinder system is positioned inside the engine. With such a solution, pipe-running is made easier.

A method according to the invention for topping up an internal combustion engine with lubricant includes the steps of first topping up with more lubricant than is required and then drawing off surplus lubricant via a level pipe.

The advantage of this method is that it ensures that the engine has an optimum lubricant level every time the method is carried out.

In an advantageous development of the method according to the invention, these steps are carried out after the engine has been stopped. The advantage of this is that the vehicle is ready for driving the next time it is started. If there should be a lack of lubricant or some other fault, the driver is informed of this directly and thus has more time to deal with the problem. Another advantage is that the lubricant is hot and thus of low viscosity, which ensures repeatable lubricant level adjustment.

In an advantageous second development of the method according to the invention, these steps are carried out in a number of cycles. The advantage of this is that the quantity of lubricant which is pumped back to the container can be minimized.

An advantageous third development of the method according to the invention includes the step of detecting that topping up with lubricant is taking place. The detection signal can be used to turn off the pump which transfers lubricant. The advantage of this is that the quantity of lubricant which is pumped back to the container can be minimized.

An advantageous fourth development of the method according to the invention includes the step of, if the control system has detected that topping up with oil has not taken place, sending a message via the control system to an operator. The advantage of this is that the operator is made aware that topping up with lubricant could not take place.

An advantageous fifth development of the method according to the invention includes the step of detecting that topping up with a sufficient quantity of lubricant has taken place. The detection signal can be used to turn off the pump which transfers lubricant. The advantage of this is that the quantity of lubricant which is pumped back to the container can be minimized.

An advantageous sixth development of the method according to the invention includes the step of, if the control system has detected that topping up with a sufficient quantity of lubricant has not taken place, sending a message via the control system to an operator. The advantage of this is that the operator is made aware that topping up with a sufficient quantity of lubricant could not take place.

Conventionally, the oil sump in an engine with a wet sump contains a greater quantity of oil than is necessary to achieve safe lubrication. The reason for this is to allow longer topping-up intervals and longer change intervals. A sump of a heavy-duty vehicle can contain up to 50 liters of oil. A normal oil change interval for heavy-duty trucks may be, for example, 45000 km. The level between minimum and maximum may be, for example, 8 liters. This means that it may be necessary to top up the oil a few times a month. Apart from longer topping-up intervals and longer change intervals, there is no advantage in having a great volume of oil in the oil sump.

On the other hand, there are many advantages in keeping the total quantity of oil in the sump at as low a level as possible, without on this account jeopardizing the lubrication of the engine. It is furthermore advantageous if the difference between the maximum and minimum levels can be kept as small as possible. One advantage of this is that friction losses (splash losses) are reduced. There is thus less oil mist in the blow-by gases which leads to lower oil consumption. Another advantage is that, with a smaller quantity of oil but the same oil-cleaning system, that is to say oil pump and oil filter, the cleanness of the oil increases as the number of times the entire quantity of oil passes through the oil filter per unit of time increases exponentially with reduced oil volume. The quicker the oil is cleaned, the fewer particles there are in the oil. Above all, it is important that large particles are cleaned out rapidly; otherwise, such large particles are ground down into smaller particles which increases the total particle surface area and thus the degree of contamination of the oil. With a high degree of cleaning, the oil can be kept sufficiently clean that oil change intervals can be extended. One advantage of a smaller quantity of oil is that less oil has to be changed when the oil is changed. Another advantage of a small quantity of oil in the oil sump is that the oil sump can be made smaller, which saves weight. This also means that the engine can be made lower, which saves space.

With a system according to the invention, a normal service is limited to topping up the oil container. The size of this is selected so that it does not have to be topped up too often. With a volume of, for example, 20 liters, it is sufficient to top up the oil every other month, and perhaps even less often. The extra container can moreover be designed and positioned in such a manner that it is easy to inspect its oil level and easy to top it up with oil. The container can also be designed so that it is easily replaceable. The container can then comprise an apparatus which allows lubricant to come out of the container only when the container is placed in a special holder.

In an advantageous embodiment, the system is actuated after a predefined time passes after the engine has been turned off. The engine is drained of oil; that is to say, the quantity of oil with which the system operates is now located in the sump. As the oil is hot, and thus of low viscosity, the oil level in the sump will be horizontal and planar. This is especially important when oil is pumped back to the container in order to achieve a predefined oil level. If, on the other hand, the oil is very cold, and thus viscous, only oil in the vicinity of the mouth of the level pipe will be drawn off. A form of depression will then be created in the oil in the vicinity of the mouth of the level pipe, and it will take a long time for the oil level to become uniform throughout the oil sump. It is therefore advantageous that this system operates with a hot engine.

BRIEF DESCRIPTION OF DRAWINGS

The invention will be described in greater detail below with reference to illustrative embodiments shown in the accompanying drawings, in which.

DETAILED DESCRIPTION

The illustrative embodiments of the invention with developments described below are to be regarded only as examples and are not in any way to limit the scope of protection of the patent claims. In this context, the lubricant is a mineral or synthetic engine oil, but could also be another substance with similar properties.

Figure 1:
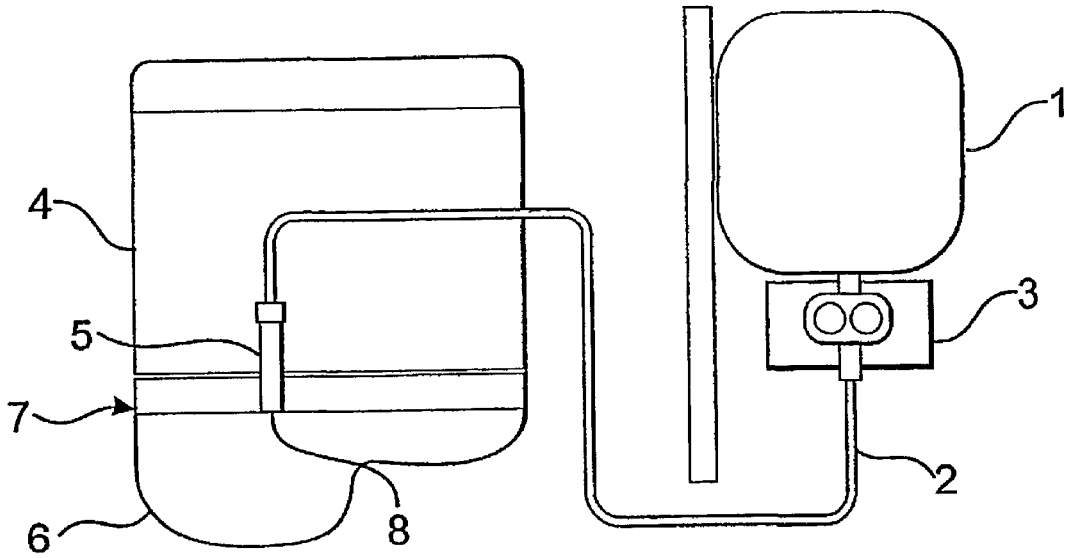
FIG. 1 is a schematic of a topping-up system, with a pump, configured according to the invention.

The first illustrative embodiment of a system for automatic topping up with oil shown in FIG. 1 consists of a container 1 for oil, a pipe 2 which connects the container 1 to the internal combustion engine 4, and an apparatus 3 for transferring oil. On the engine side, the pipe 2 is connected to a level pipe 5 which is positioned so that its mouth 8 is located in the oil sump 6. The height of the mouth 8 of the level pipe defines the optimum oil level limit 7 in the oil sump 6 for the engine. In order for it to be possible to reliably and accurately define an oil level with a level pipe 5 according to the invention, the mouth 8 of the level pipe is positioned so that its opening area is directed towards the bottom of the oil sump and so that the opening area is parallel to the oil surface in the oil sump 6. It may therefore be necessary to adapt the positioning of the mouth 8 of the level pipe depending on how the engine is located when mounted. It is advantageous for the mouth 8 of the level pipe to be positioned centrally in the sump 6.

In a first illustrative embodiment, the apparatus 3 can be a pump which is driven by electricity, hydraulics, air or a drive belt via the flywheel. It is possible to control the pump with an electric signal from a control unit (not shown). It is advantageous to use an electrically driven gear pump. The control unit can either be a special control circuit adapted solely for pump control or a processor-based control unit with suitable software. It is advantageous to integrate the control unit of the pump into one of the existing control units of the vehicle.

In this case, the system is adapted for replenishing consumed oil after the engine has been turned off after a driving session. When the engine has been turned off, the system waits a suitable time in order to allow the engine to be drained of oil so that all the oil will be present in the sump 6. This time can be of the order of minutes, and a suitable time delay may be, for example, 1 minute. After this, oil is pumped from the container 1 to the oil sump 6. The quantity of oil which is pumped to the sump 6 is determined by the size of the pump 3 and the time for which the pump 3 is operated. The viscosity of the oil also affects the quantity of oil pumped per unit of time.

The quantity of oil which is to be pumped to the sump 6 can be determined in a number of ways.

In a first illustrative embodiment, an oil quantity which is greater than the maximum quantity of oil which can be consumed during a driving session is pumped into the sump 6. This can be effected by making the pump 3 pump oil for a time ($T_{in}$) which corresponds to this quantity of oil at a given external temperature. It is thus ensured that the oil level after a top-up is always above the predefined level 7.

A normal driving session can vary between minutes for a distribution vehicle to, in some cases, more than 20 hours for, for example, timber vehicles or construction vehicles. This means that the oil consumption during a normal driving session rarely exceeds 1 liter.

When topping up with oil has taken place, the system draws oil back to the container 1. In a first illustrative embodiment, the pump 3 is made to draw oil for a time ($T_{out}$) which exceeds the time $T_{in}$ for which the oil was pumped into the sump 6. $T_{out}$ can be calculated using a predetermined factor greater than $T_{in}$, for example 10–40% greater. When the oil in the sump 6 reaches the mouth 8 of the level pipe, that is to say when the optimum oil level 7 has been reached, the pump 3 starts to draw air instead. It is then ensured that the optimum predefined oil level 7 is always achieved.

In one development or aspect, the oil consumption during the driving session is calculated in order to arrive at the quantity of oil necessary for topping up. The oil consumption is preferably a function of the fuel consumption. Other parameters which can affect the oil consumption are driving distance, total number of engine revolutions, operating time, load and the number of starts. As these parameters are available in one of the control units of the vehicle, they can be used in order to calculate the oil consumption during the driving session. In the case of short driving sessions, it would moreover be possible to save information from preceding driving sessions so that the topping-up procedure does not have to be carried out more often than necessary, for example not more frequently than an accumulated calculated consumption of, for example, 0.5 liter. Other parameters which the control unit may need for controlling the pump are, for example, external temperature and engine temperature.

Using one or more of these parameters as a basis, the control unit can calculate the approximate oil consumption. The control unit can then control the pump 3 to pump a quantity of oil into the sump 6 which exceeds this calculated oil quantity by a suitable factor, for example 10%. The quantity of oil which is then pumped back to the container 1 has then been limited appropriately.

In one development, an apparatus is used in order to detect when oil is being pumped back to the container.

In another development, the electric current to the pump 3 is measured. When the pump 3 pumps oil, it runs relatively heavily, and the power consumption is relatively high. When the pump 3 begins to pump air, it runs considerably lighter, and the power consumption is lower. This applies both when the pump 3 pumps oil to the sump 6 and when it pumps oil to the container 1. The control unit monitors the current signal and can in this way detect whether the pump 3 is pumping oil or not. The control unit can use this information, for example, for controlling the pump 3 and/or for sending a message to the operator. The control unit can, for example, turn off or reverse the pump 3. The message to the operator may be, for example, that topping up with oil has taken place or has not taken place.

Figure 2:
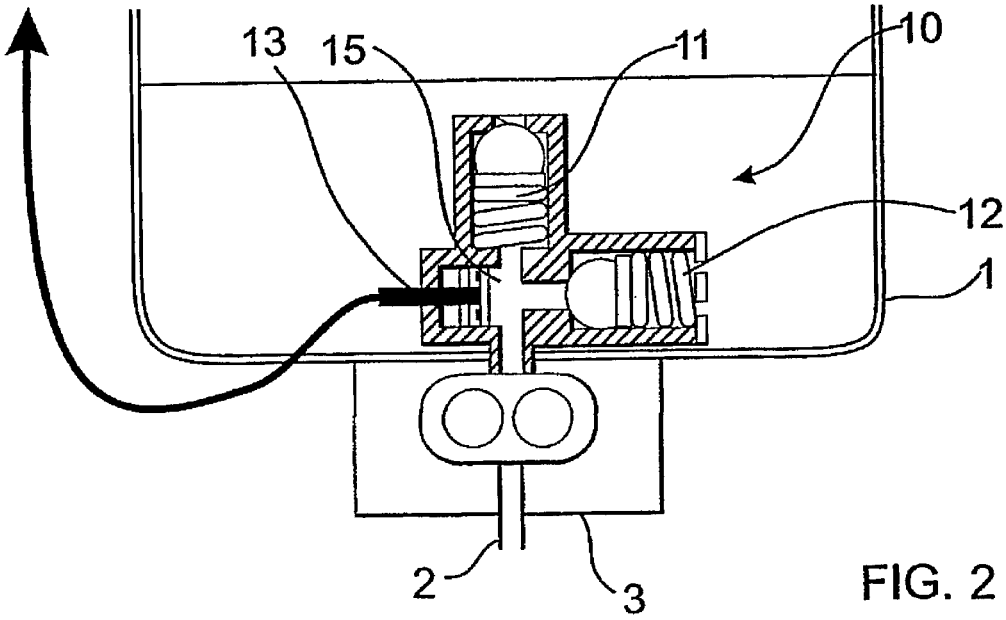
FIG. 2 is a partial cross-sectional, partial cutaway schematic view that shows a valve apparatus with a pressure monitor according to the invention.

In a development, the apparatus for detecting whether oil is being pumped to the container 1 consists of a valve apparatus 10 configured according to FIG. 2. The apparatus is installed in the container 1 and consists of a first valve 11 which opens when the pump 3 pumps oil to the sump 6 (compare FIG. 1), a second valve 12 which opens when the pressure in a cavity 15 exceeds a certain value, for example 0.5 bar, and an inexpensive pressure monitor 13 with an operating value which is higher than the opening pressure of the valve 12. When air is pumped back by the pump 3, the air will pass out of an air opening (not shown). The air opening is dimensioned so that the pressure in the cavity 15 never becomes greater than the operating pressure of the pressure monitor 13 and the opening pressure of the second valve 12 when air is being pumped. When oil is pumped back by the pump 3, the pressure in the cavity 15 increases because the oil cannot pass out of the air opening sufficiently rapidly. The pressure monitor 13 then closes and sends a signal to the control unit. The control unit can use this signal, for example, to control the pump 3 and/or for sending a message to the operator. The control unit can, for example, turn off or reverse the pump 3. The message to the operator may be, for example, that topping up with oil has taken place or has not taken place.

When pumping back takes place, that is to say when the pump 3 has been reversed so that oil or air is pumped from the sump 6 to the container 1, first the oil in the pipe 2 will be pumped back, and then either oil or air will be pumped. If the oil level in the sump exceeds the desired level 7, that is to say if the oil level in the sump 6 is higher than the mouth 8 of the level pipe, oil will be pumped back. This takes place until the oil level has fallen to the level of the mouth 8 of the level pipe. Air will then be drawn into the level pipe 5, and air will thus be pumped back to the container 1.

The control system can use this for detecting whether old oil from the sump 6 is being pumped back to the container 1. When the control system has reversed the pump 3, it waits for a time corresponding to the time it takes to pump back the oil in the pipe 2 between the container 1 and the sump 6. After this waiting time, the control system verifies whether oil is still being pumped. If this is the case, it is oil from the sump 6 (old oil) which is being pumped back. The control system can use this information for turning off the pump 3 and thus preventing old oil from being pumped back to the container 1.

This is repeated until the entire quantity of oil has been pumped in. The advantage of pumping oil over a number of cycles is that the quantity of old oil which is pumped back to the container is reduced. Intermixing of old oil in the oil container is then reduced.

In a development, the quantity of oil for topping up is divided into a number of part quantities. A suitable number may be, for example, 2–10 part quantities. The first part quantity is pumped in by the pump being made to pump for a part time interval. The pump is then reversed, and the control unit detects whether old oil is being pumped back to the container 1. If old oil is not being pumped back, the topping-up procedure is repeated with another part quantity until the apparatus senses that old oil is being pumped back to the container 1 and then the topping-up procedure is stopped. In this case, on the whole, no old oil is pumped back to the container 1, and, more-over, the quantity of extra oil in the sump 6 which is not pumped back is negligibly small.

In a development, the system can sense whether the oil container 1 is empty. If, after all the calculated topping-up with oil has taken place, the system has not received a signal that oil has been pumped back, the system can, for example, be made to carry out another topping-up procedure. If, after this topping-up procedure, the system has not received a signal that the pump 3 has pumped oil back, it is likely that the container 1 is empty; that is to say, sufficient topping up with oil could not take place. An error message can then be generated by the control unit, either so as to remind the driver that topping up with oil is necessary or in order for the oil system to be inspected.

Another way of detecting whether the oil in the container 1 has been used up is to use a level monitor positioned in the container 1. As the level monitor is not located in the oil sump 6 but outside the engine, it can be of a simple, inexpensive type.

In a development, there is a special service position in the control system, which allows oil to be pumped continuously from the container 1 to the sump 6. The service position can be selected by, for example, a special program code or by a switch. This service position is used when the oil is changed. The oil can then be filled into the container 1 and then transferred to the sump 6 by the pump 3. It is advantageous to use a special external oil container which contains the total quantity of oil for topping up. In this case, the oil level in the sump 6 does not have to be monitored. Another way is for the control system to pump oil in over a longer time, for example corresponding to 3 liters. The pump is then reversed. If the control system detects that air is being drawn back, topping up is repeated. This is repeated until the control system detects that oil is being pumped back. The control system then returns to its normal position for fine adjustment of the oil level.

Figure 3:
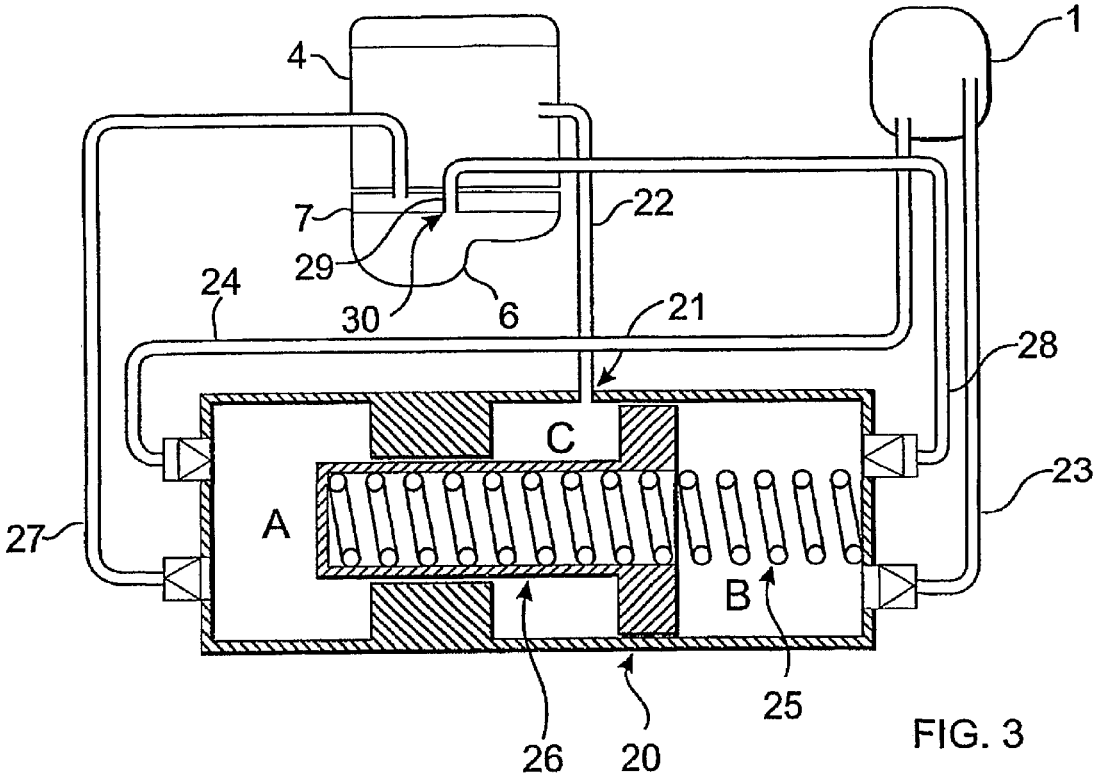
FIG. 3 is a partial cross-sectional, partial cutaway schematic view that shows a hydraulic cylinder system according to the invention.

In a second illustrative embodiment, the system for topping up with oil according to the invention consists of a hydraulic cylinder system which is positioned outside the engine according to FIG. 3. The cylinder system 20 consists of three chambers, A, B and C. When the engine is started, the third chamber C is filled with oil from the engine via a first pipe 22. This takes place when the oil pressure of the engine is greater than the biasing force of a spring 25. This takes place slowly via a throttling point 21. At the same time, the second chamber B, which contains oil that has been drawn out of the engine in a previous cycle, is emptied via a second pipe 23 to the container 1. At the same time, the first chamber A is filled with oil from the container 1 via a third pipe 24.

When the engine is turned off, the oil pressure of the engine disappears from the third chamber C via the throttling point 21. The spring 25 then presses a piston 26 back. The contents of the first chamber A are emptied via a fourth pipe 27 to the sump 6. At the same time, via a fifth pipe 28, the second chamber B draws surplus oil off from the sump 6 via the level pipe 29. When the oil level reaches the mouth 30 of the level pipe, the second chamber B draws air instead of oil. It is then ensured that the oil level in the sump 6 corresponds to a predefined optimum oil level 7.

The volume of the first chamber A should be greater than the maximum oil consumption during a driving session. A driving session can vary between minutes for a distribution vehicle and, in some cases, more than 20 hours for, for example, timber vehicles or construction vehicles. The volume of the first chamber A is therefore suitably selected to be, for example, 0.5–1.0 liter. The volume of the second chamber B should be greater than that of the first chamber A, for example 20% greater. The volume of the third chamber C is suitably selected to be, for example, 0.1–0.2 liter.

Figure 4:
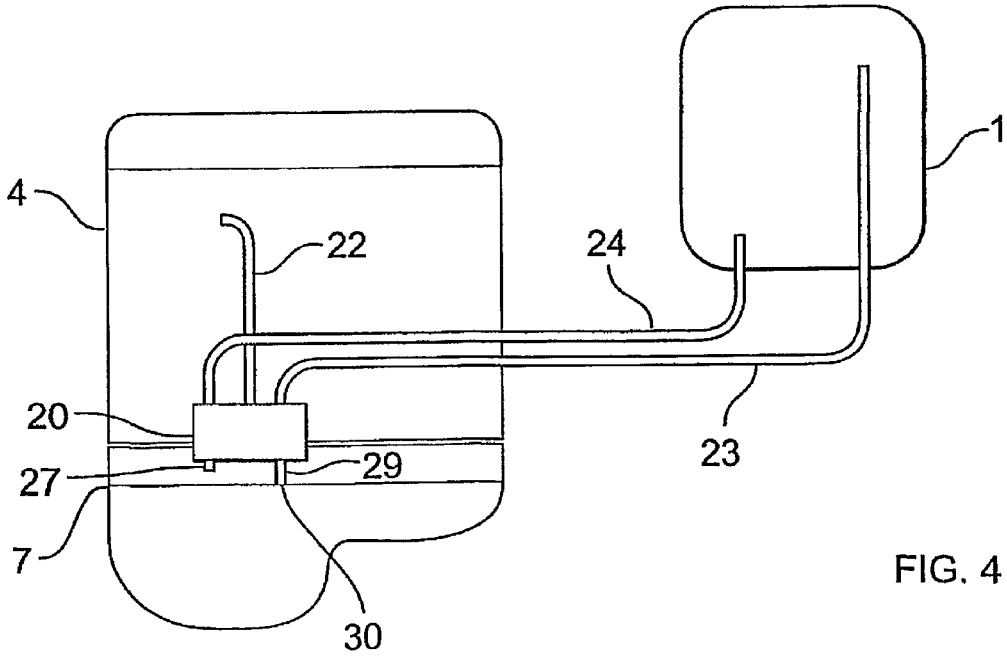
FIG. 4 is a schematic view showing a hydraulic cylinder system configured according to the invention and mounted inside the engine.

In a development, the hydraulic cylinder system 20 is positioned inside the internal combustion engine according to FIG. 4. As the functioning of the hydraulic cylinder system 20 is described in detail above and in FIG. 3, only the connections to the cylinder system 20 are described here. When the engine is started, the third chamber C is filled with oil from the engine via a first pipe 22. At the same time, the second chamber B is emptied of oil via a second pipe 23 to the container 1. At the same time, the first chamber A is filled with oil from the container 1 via a third pipe 24. When the engine is turned off, the contents of the first chamber A are emptied via a fourth pipe 27 to the sump 6. At the same time, the second chamber B draws surplus oil off from the sump 6 via the level pipe 29. When the oil level 7 reaches the mouth 30 of the level pipe, the second chamber B draws air instead of oil. It is then ensured that the predefined optimum oil level 7 is achieved.

One advantage of this is that the cylinder system 20 is heated up during driving so that the oil in the first chamber A and the second chamber B is heated and thus of low viscosity. Pipe-running is furthermore simplified and is thus less expensive.

A first illustrative embodiment of the method of topping up an internal combustion engine with oil according to the invention includes the steps of topping up with more oil than necessary and then drawing off surplus oil via a level pipe. The advantage of this is that the method ensures that the engine has an optimum oil level every time the method is carried out.

In a development of the method, these steps are carried out after the engine has been stopped. The advantage of this is that the vehicle is ready for driving next time it is started. If there should be a lack of oil or some other fault, the driver is informed of this directly and thus has more time to deal with the problem. Another advantage is that the oil is hot and thus of low viscosity, which ensures repeatable oil level adjustment.

In a development, these steps are carried out in a number of cycles. The advantage of this is that the quantity of oil which is pumped back to the container can be minimized.

In a development, the method also includes the step of detecting that topping up with oil is taking place and/or that topping up with a sufficient quantity of oil has taken place.

In a development, the method also includes the step of sending an operator a message with regard to topping up with oil being carried out.

The invention is not to be regarded as being limited to the illustrative embodiments described above, but a number of further variants and modifications are possible within the scope of the patent claims below. The system can be used, for example, for controlling the liquid level in a container holding any consumable liquid; for example, water, coolant or hydraulic oil.

What is claimed is:

1. A system for automatically topping up an internal combustion engine with lubricant, the sump of which has a predefined lubricant level, said system comprising:

a lubricant container that is connected to the internal combustion engine and an apparatus for transferring lubricant between the container and the sump;

a level pipe connected to the container being positioned in the internal combustion engine, a mouth of which pipe is positioned at the level of the predefined lubricant level; and the apparatus for transferring lubricant comprising a reversible pump adapted to transfer lubricant both from the container to the internal combustion engine and from the internal combustion engine to the container and a controller for actuating the pump after a predefined time delay after the engine has been stopped.

2. A system for automatically topping up an internal combustion engine with lubricant, the sump of which has predefined lubricant level, said system comprising:

a lubricant container that is connected to the internal combustion engine and an apparatus for transferring lubricant between the container and the sump;

a level pip connected to the container being positioned in the internal combustion engine, a mouth of which pipe is positioned at the level of the predefined lubricant level; and the apparatus for transferring lubricant comprising a reversible pump adapted to transfer lubricant both from the container to the internal combustion engine and from the internal combustion engine o the container and wherein the pump is controlled by a control unit, the control signal of which is a function of at least one of the following parameters: fuel consumption, driving distance, total number of engine revolutions, the number of starts, accumulated calculated oil consumption, external temperature and engine temperature.

3. A system for automatically topping up an internal combustion engine with lubricant, the sump of which has predefined lubricant level, said system comprising:

a lubricant container that is connected to the internal combustion engine and an apparatus for transferring lubricant between the container and the sump;

a level pipe connected to the container being positioned in the internal combustion engine, a mouth of which pipe is positioned at the level of the predefined lubricant level; and the apparatus for transferring lubricant comprising a reversible pump adapted to transfer lubricant both from the container to the internal combustion engine and from the internal combustion engine to the container and a controller for actuating the pump so that the transfer of lubricant to and from the sump takes place in more than one cycle.

4. The system as recited in any one of claims 1, 2 and 3, wherein the pump (3) is electrically operable.

5. The system as recited in claim 4, further comprising:

a detection apparatus which can detect whether lubricant is being transferred from the internal combustion engine to the container and/or from the container to the internal combustion engine.

6. The s stem as recited in claim 5, wherein the detection apparatus consists of a pressure monitor (13) and/or a current detector.

7. The stem as recited in claim 5, wherein the system, after having pumped a predefined number cycles without having detected that lubricant is being transferred, generates a message signal.

8. The system as recited in claim 5, wherein the system has a service position for topping up the internal combustion engine with lubricant.

9. The system as recited in claim 2, wherein the control signal is a function of fuel consumption.

10. The system as recited in claim 2, wherein the control signal is a function of fuel consumption and at least one of: driving distance, total number of engine revolutions, the number of starts, accumulated calculated oil consumption, external temperature and engine temperature.

11. A method of topping up an internal combustion engine with lubricant, comprising the step of:

topping up with more lubricant than necessary;

drawing off surplus lubricant via a level pipe; and executing said steps after a predefined time delay after the engine has been stopped.

12. The method as recited in claim 11, further comprising:

detecting that topping up with lubricant is taking place.

13. The method as recited in claim 11, wherein the combination of steps is carried out a number of times in succession.

14. The method as recited in claim 11, further comprising:

detecting that topping up with a sufficient quantity of lubricant has taken place.

15. The method as recited in claim 11, further comprising, if the control system has detected that either topping up with lubricant has not taken place and/or topping up with a sufficient quantity of lubricant has not taken place, sending a message via the control system to an operator.

* * * * *